US006550159B1

(12) United States Patent
Madore

(10) Patent No.: US 6,550,159 B1
(45) Date of Patent: Apr. 22, 2003

(54) SKATE HAVING DYNAMIC RANGE OF MOTION

(75) Inventor: Carl Madore, Hampton, NH (US)

(73) Assignee: Bauer Nike Hockey Inc., Montreal Quebec (CA)

( * ) Notice: Subject to any disclaimer, the term of this patent is extended or adjusted under 35 U.S.C. 154(b) by 0 days.

(21) Appl. No.: 09/814,730

(22) Filed: Mar. 23, 2001

(30) Foreign Application Priority Data

May 25, 2000 (CA) ..... 2,309,565

(51) Int. Cl.[7] ..... A43B 5/16; A63C 1/30

(52) U.S. Cl. ..... 36/115; 36/89; 280/11.18; 280/11.221

(58) Field of Search ..... 36/115, 89, 58.5, 36/58.6; 280/11.18, 11.221

(56) References Cited

U.S. PATENT DOCUMENTS 2,531,763 A * 11/1950 Andre ..... 36/117.6
2,563,763 A * 8/1951 Vietas ..... 2/22
2,789,374 A * 4/1957 Planert ..... 280/11.36
3,028,861 A * 4/1962 Shapiro ..... 128/DIG. 15
4,835,885 A * 6/1989 Hoshizaki et al. ..... 36/115
5,072,529 A 12/1991 Graf
5,819,439 A * 10/1998 Sanchez ..... 36/50.1
5,933,986 A 8/1999 Donnadieu
5,950,335 A * 9/1999 Okajima ..... 36/115
5,992,057 A * 11/1999 Monti ..... 36/50.1
6,018,892 A 1/2000 Acheson et al.

FOREIGN PATENT DOCUMENTS

CA 1066500 11/1979
SE PCT/SE94/01102 11/1994

* cited by examiner

*Primary Examiner*—Ted Kavanaugh

(57) ABSTRACT

A skate boot is disclosed which comprises a foot element adapted to be mounted to a ground engaging skating implement and for receiving at least partially the foot of a skater, and an articulated cuff for encircling and supporting the ankle of a skater. The articulated cuff is partially inserted in the foot element and slidably coupled to the foot element to permit unrestrained limited pivotal motion of the articulated cuff relative to an axis coinciding approximately with the pivot axis of the skater's ankle.

56 Claims, 7 Drawing Sheets

SKATE HAVING DYNAMIC RANGE OF MOTION

FIELD OF THE INVENTION

The invention relates to skate boot construction such as used in ice skates in general and more particularly for playing hockey, and for in-line roller skates.

BACKGROUND OF THE INVENTION

Skate boots and particularly hockey skate boots have always been fairly rigid, especially in the ankle area. This rigidity provides a high performance skate, which properly support the ankle of the skater. Providing flexibility at the ankle area of the skate boot has always been achieved at the expense of support and performance. Some skate boots have been designed with cutouts at the level of the ankle, on each side of the boot where creases would normally develop. These cutouts effectively increase flexibility of the skate boot but reduce the ankle support and therefore the performance of the skate. Many of the design approaches for skate boots in the prior art have failed to appreciate the relationship of the dynamics of the foot in the skating motion, relative to the overall structure and operation of the skate boot.

Skaters generally want a certain amount of rigidity in the skates around the ankle so that proper support is provided. On the other hand, when the skater is breaking in a new pair of skates, the rigidity makes this break-in period more difficult. Thus it is desirable to provide such rigidity in a manner that still permits localized flexibility to make the skate more comfortable. Some skaters have been known to leave the upper eyelets of their skate boots untied in order to get the flexibility in the ankle area that they require for their style of skating or simply to increase the level of comfort of the skate boot.

Thus there is a need for a skate boot that provides flexibility and comfort at the ankle area, while a certain amount of rigidity in the skates around the ankle so that proper support is provided.

OBJECTS AND STATEMENT OF THE INVENTION

It is thus an object of the invention to provide a skate boot adapted to be flexible at the ankle area while providing good lateral support for the ankle of the skater.

It is another object of the invention to provide a skate boot that provides performance and flexibility without having to be "broken in" by the skater.

As embodied and broadly described herein, the invention provides a skate boot comprising a foot element adapted to be mounted to a ground engaging skating implement and for receiving at least partially the foot of a skater, and an articulated cuff for encircling and supporting the ankle of a skater. The articulated cuff is partially inserted in the foot element and slidably coupled to the foot element to permit unrestrained limited pivotal motion of the articulated cuff relative to an axis coinciding approximately with the pivot axis of the skater's ankle.

Advantageously, the skate boot comprises a belt like coupling for linking together the articulated cuff and the foot element. The foot element comprises a passageway on each side of the skater's ankle and the articulated cuff comprises belt like lateral extensions inserted in each passageway thereby slidably coupling the articulated cuff to the foot element. Preferably, the passageway is made of a lateral shoulder attached to each quarter of said foot element with a lower stitching line and an upper stitching line which define said passageway therebetween. The articulated cuff includes an ankle brace supporting the back and sides of the skater's ankle and a tendon guard extending upwardly from the ankle brace for supporting and protecting the lower rear portion of the skater's leg, the tendon guard further comprising a reinforcement member which itself comprises the belt like lateral extensions.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings. Please note that there are three types of stippled lines in the drawings: the single dot lines refer to the stitching lines of the skate boot, the line-double dots lines refer to the internal parts of the skate boot, and the line-single dots lines refer to the accessory. In FIGS. 1 to 7*b*, a blade is shown as an accessory whereas in FIG. 8 an in-line roller chassis is shown as an accessory.

FIG. 1 is a side elevational view illustrating a skate boot according to the invention;

FIG. 2 is a side elevational view of skate boot showing in stippled lines the articulated cuff partially inserted in the foot element according to the invention;

FIG. 3 is a cross-sectional view taken at line 3—3 of FIG. 2 showing the inside of a skate boot according to the invention;

FIG. 4 is a top plan view of the skate boot of FIG. 1 with the tongue of the skate boot partially cut out in order to better illustrate the internal parts of the skate boot according to the invention;

FIG. 5 is a cross-sectional view taken at line 5—5 of FIG. 2 showing the connection of the articulated cuff with the foot element of the skate boot according to the invention;

FIG. 6 is rear elevational view of the skate boot of FIG. 1 showing in stippled lines the articulated cuff of the skate boot according to the invention;

FIG. 7*b* partial side elevational view of the skate boot according to the invention showing in stippled lines the articulated cuff at its forwardmost position.

Figure 1:
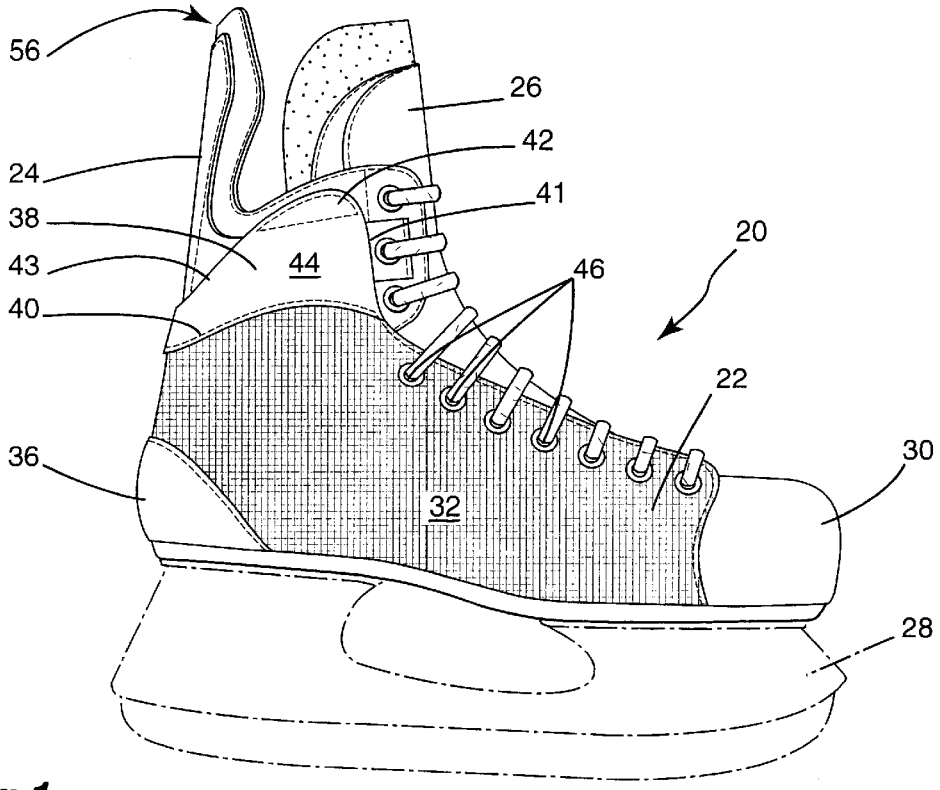

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

FIG. 1 illustrates a skate boot 20 according to the invention comprising a foot element 22, an articulated cuff 24, a tongue 26 and a skate blade 28 shown in stippled lines as an example of an accessory for skate boot 20. Foot element 22 is adapted to enclose and support a skater's foot and comprises a toe cap 30, quarters 32 and 34 on each side of foot element 22, a reinforcement heel counter 36 stitched to both quarters 32 and 34, and a lateral shoulder 38 extending around the back of the ankle from the front of quarter 32 all the way around to the front of quarter 34. Lateral shoulder 38 is attached to quarter 32 with a first stitching line 40 on the lower side and a second looped stitching line 42 on the upper side. There are no stitching lines at the front and at the rear of lateral shoulder 38 leaving a front opening 41 and a rear opening 43. Stitches 40 and 42 effectively connect lateral shoulder 38 to quarter 32 and 34 and create passageways 44 between quarter 32 and 34 and lateral shoulder 38 extending from front opening 41 to rear opening 43. Foot element 22 also comprises lace eyelets 46 to tighten quarters 32 and 34 over the skater's foot.

Figure 2:
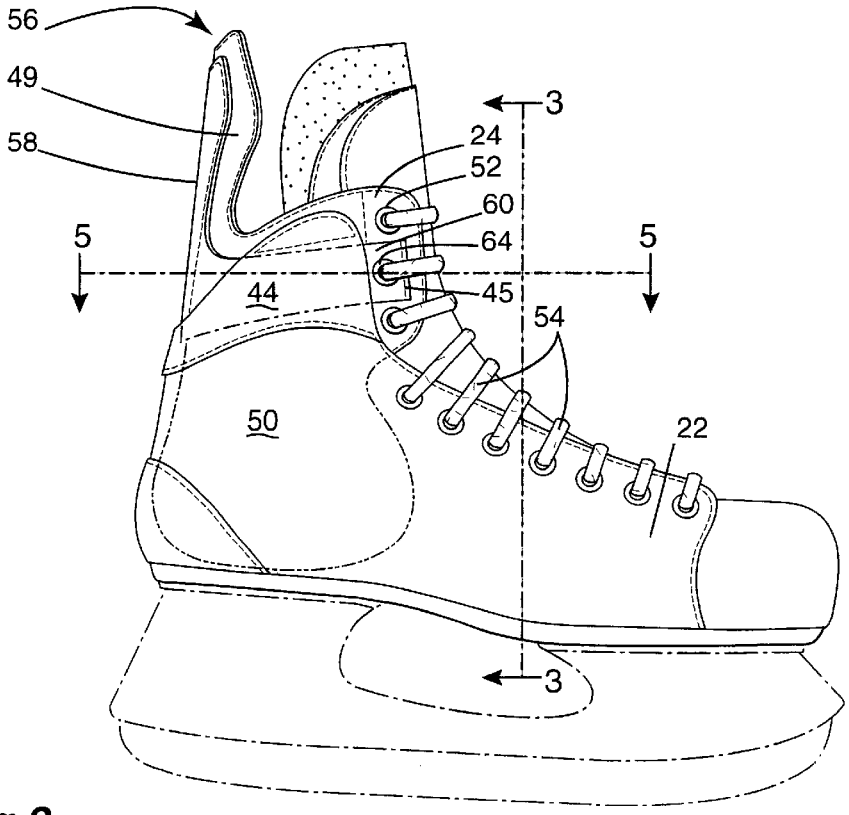

Referring now to FIG. 2 where the portion of articulated cuff 24 which is inserted in foot element 22 is shown in stippled line (line-doubled dots-line), it can be seen that articulated cuff 24 extends almost to the bottom of foot element 22. Articulated cuff 24 comprises an ankle brace 50 made of padded leather or other suitable material, which wraps around the back and sides of the skater's ankle and supports it. Ankle brace 50 extends above foot element 22 and is provided with lace eyelets 52 located at the frontal ankle area of skate boot 20. At the rear, ankle brace 50 extends upwardly to provide the padding element for tendon guard 56. Tendon guard 56 is made of the upward extension 49 of ankle brace 50 and a more rigid reinforcement member 58 sewn or otherwise attached to upward extension 49 of ankle brace 50. Reinforcement member 58 is preferably made of a plastic material or nylon but may also be made of any semi-rigid material. Reinforcement member 58 supports the back of the skater's ankle more rigidly and features belt like lateral extensions 60 and 62, one on each side of the skater's ankle which are inserted into passageways 44. Lateral extension 60 is inserted onto rear opening 43, exits front opening 41 and is sewn by a stitching line 45 to the front portion of ankle brace 50. An eyelet 64 is provided at the forward end of lateral extension 60, which is co-axial with the middle eyelet 52 of ankle brace 50. It must be understood that lateral extension 62, which is located on the inside of skate boot 20 and its construction are a mirror image of lateral extension 60. A lace 54 is channeled though eyelets 46 and though eyelets 52 and 64 to close and tighten skate boot 20. The belt like lateral extensions 60 and 62 inserted into each passageway 44 provide a means of coupling articulated cuff 24 to foot element 22. This coupling means provides articulated cuff 24 with some degrees of freedom. Articulated cuff 24 is able to partially pivot or flex forward and backward relative to foot element 22 and also to partially rotate about a vertical axis coinciding approximately with the longitudinal axis of the skater's lower leg. Since the bottom portion of ankle brace 50 is not connected to foot element 22, it is able to follow the movement of the skater's ankle while adequately supporting it. Articulated cuff 24 is adapted primarily to provide support to the skater's ankle and secondly to allows relative motion between articulated cuff 24 and foot element 22 so that in every position, the skater's ankle is properly supported yet it is not restricted in its motion.

Figure 3:
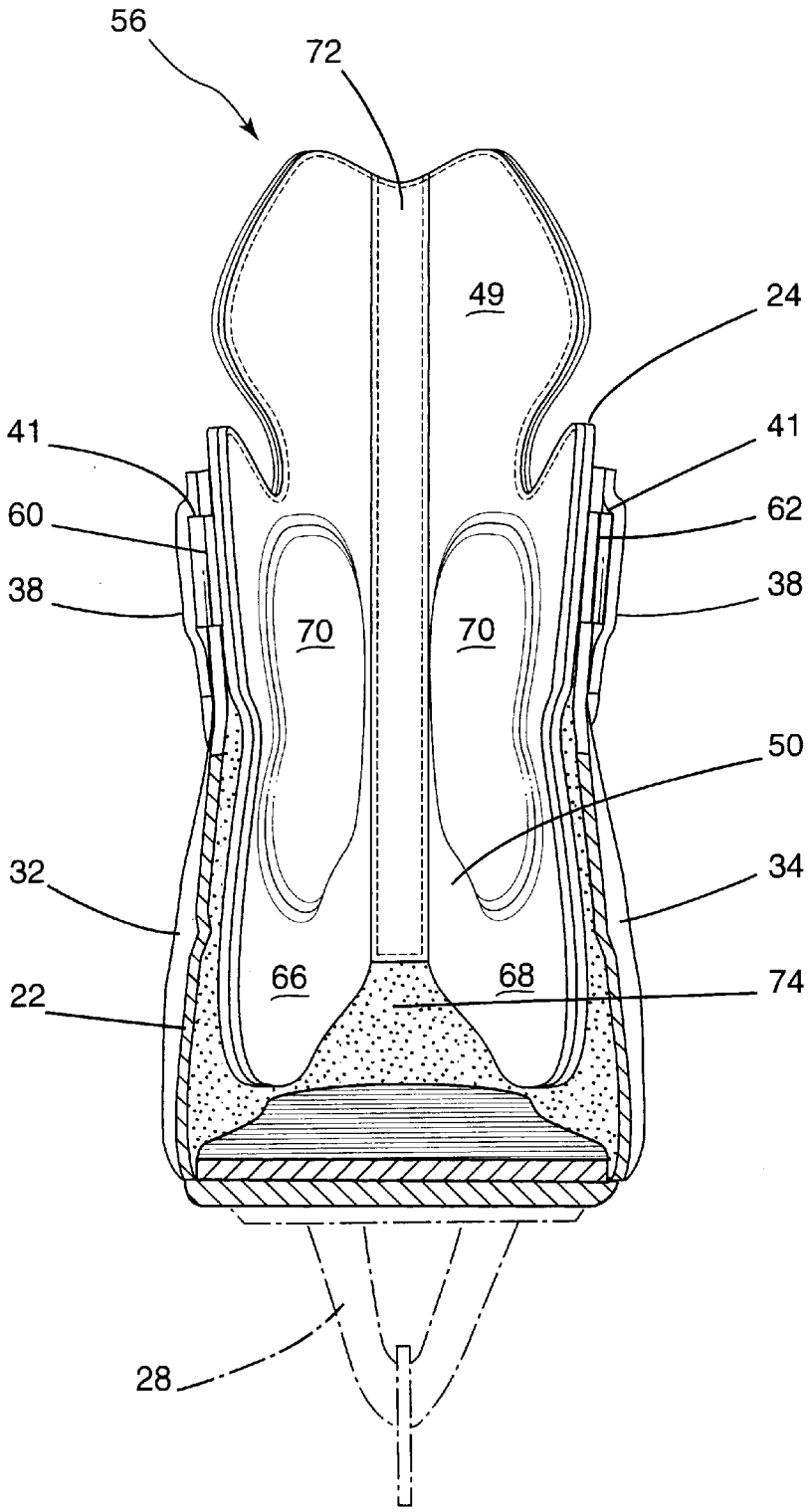

FIG. 3, which is a cross-sectional view of skate boot 20 taken at line 3—3, illustrates the interior of skate boot 20 and more specifically the lay out of articulated cuff 24. Articulated cuff 24 is made of ankle brace 50 and upper extension 49. Ankle brace 50 includes a pair of padded side flaps 66 and 68 each having a malleoli cushion 70 adapted to cushion and protect the malleolis of the skater. A narrow band 72 is sewn to the central portion of articulated cuff 24, which is aligned with the skater's Achilles' tendon when skate boot 20 is worn. Narrow band 72 is thinner than padded side flaps 66 and 68 providing added room for the back of the skater's ankle. The lower portion of ankle brace 50, directly below band 72, has an open space 74 adapted to provide slightly more room and freedom to the skater's heel. Each side flaps 66 and 68 extend down on each side of the skater's heel to provide support while the central portion of the skater's heel is left uncovered. As previously mentioned, ankle brace 50 has an upward extension 49 which forms the padded portion of tendon guard 56. FIG. 3 shows the end portions of lateral extensions 60 and 62 exiting from openings 43, which are sewn or otherwise attached to their respective side flaps 66 and 68. Lateral extensions 60 and 62 inserted into passageways 44 maintain articulated cuff 24 connected to foot element 22 while providing some freedom of movement between them.

Figure 4:
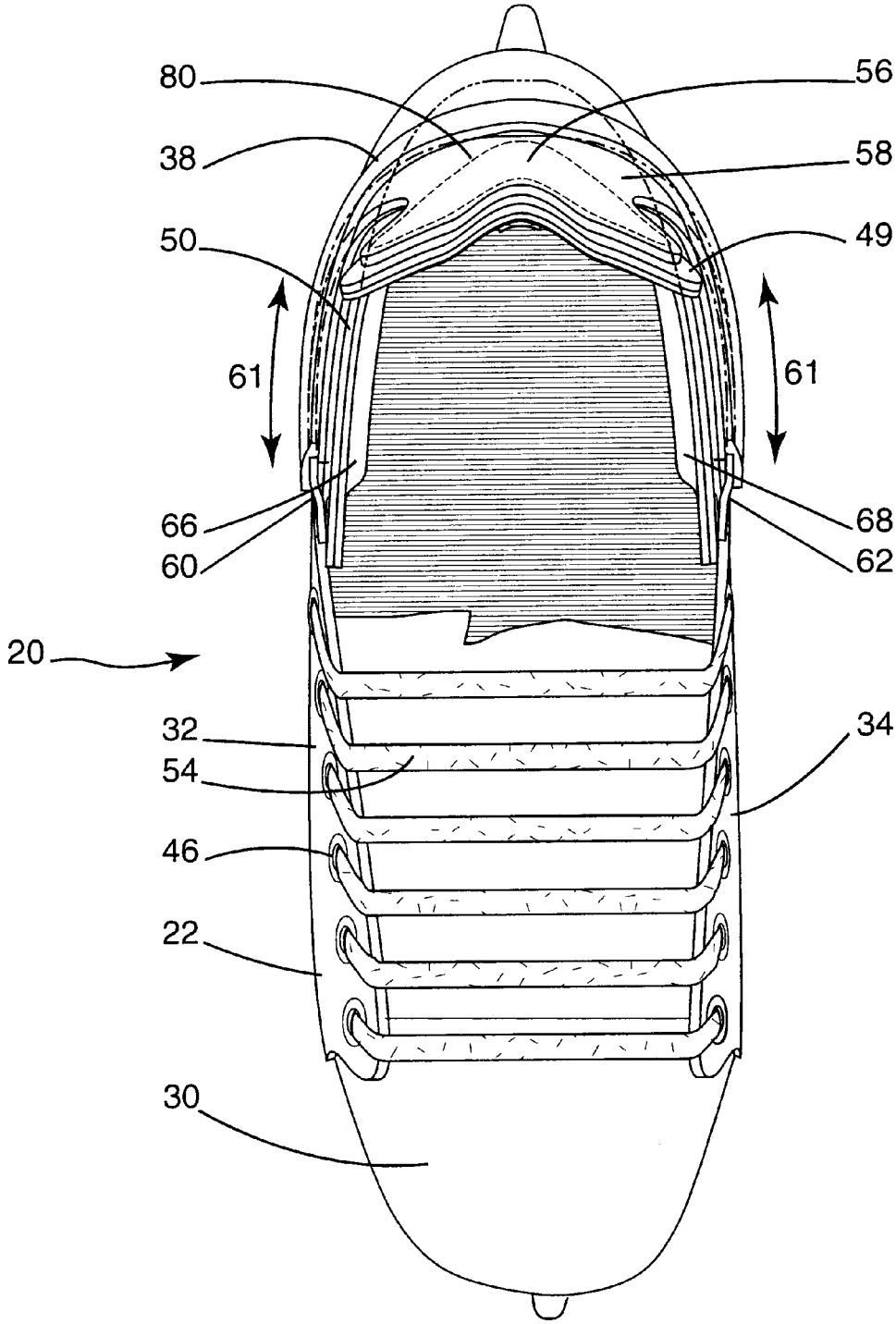
Figure 5:
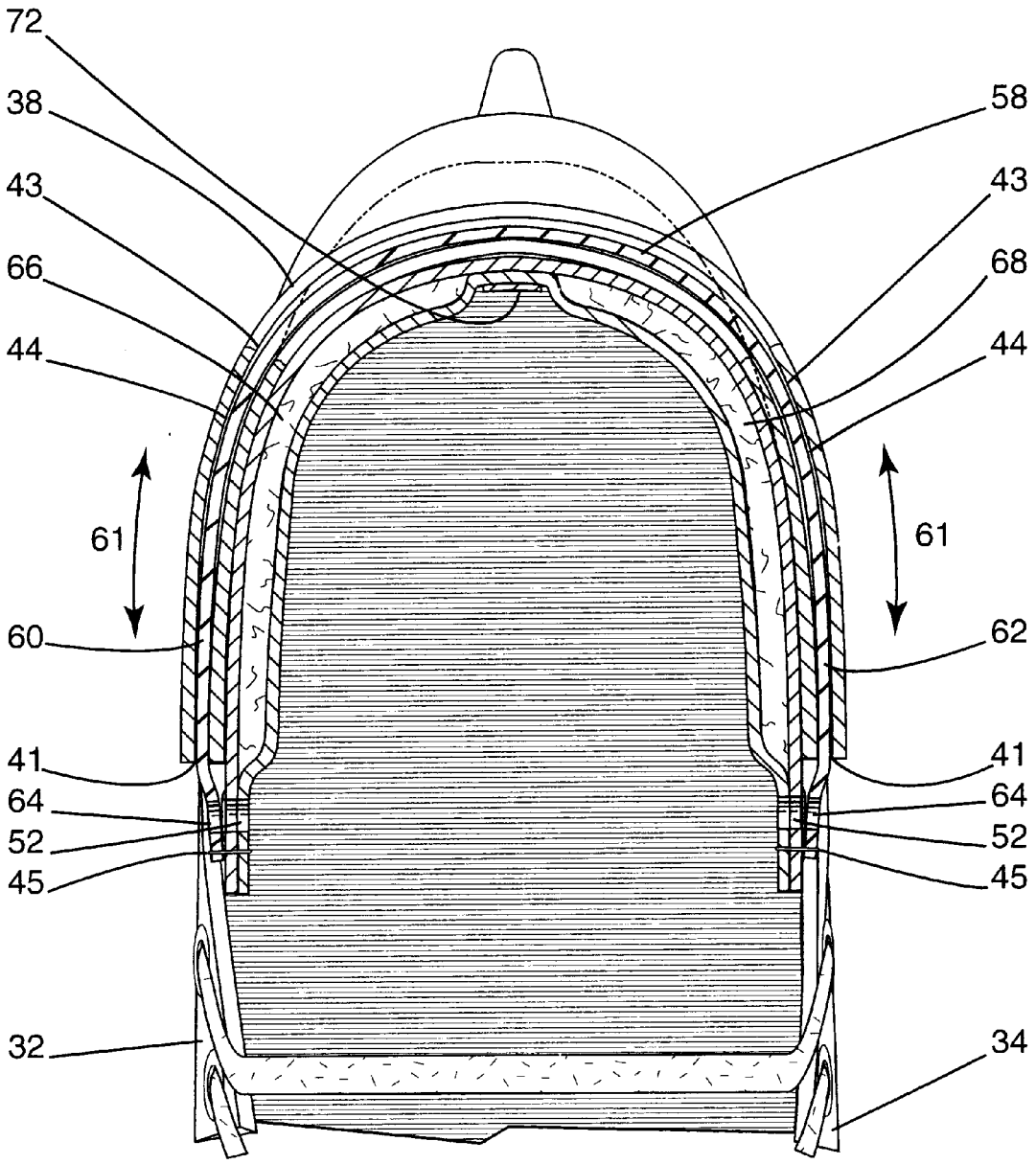

FIG. 4 provides a top plan view of skate boot 20 and illustrates how lateral extensions 60 and 62 are connected to each side flaps 66 and 68 at 75 and 76. FIG. 4 also illustrates that tendon guard 56 is partially angled forward and is constructed of the combination of the upward extension 49 of ankle brace 50 and reinforcement member 58. FIG. 5 is a cross-sectional view taken at line 5—5 of FIG. 2 and specifically illustrates how belt like lateral extensions 60 and 62 of reinforcement member 58 are enclosed and guided by the walls of passageways 44. Each lateral extension 60 and 62 is able to slide freely into each passageway 44. The connections of eyelets 64 to middle eyelets 52 restrict the backward movement of each lateral extension 60 and 62 while the rear main portion of reinforcement member 58 restricted the forward movement of each lateral extension 60 and 62. It should be noted that while articulated cuff 24 is adapted to move forward and backward as indicated by arrows 61, it is also adapted to rotate partially. Lateral extension 60 may move forward while lateral extension 62 moves backward thereby allowing a partial rotational movement of articulated cuff 24. The range of rotation of articulated cuff 24 is restricted by each sewing line 45. The backward movement of lateral extension 62 is stopped by the connection of lateral extension 62 with side flaps 68 at eyelet 64, and similarly, the backward movement of lateral extension 60 is stopped by the connection of lateral extension 60 with side flaps 66 at eyelet 64. The rotational capability of articulated cuff 24 however limited provides an added degree of freedom to skate boot 20.

Figure 6:
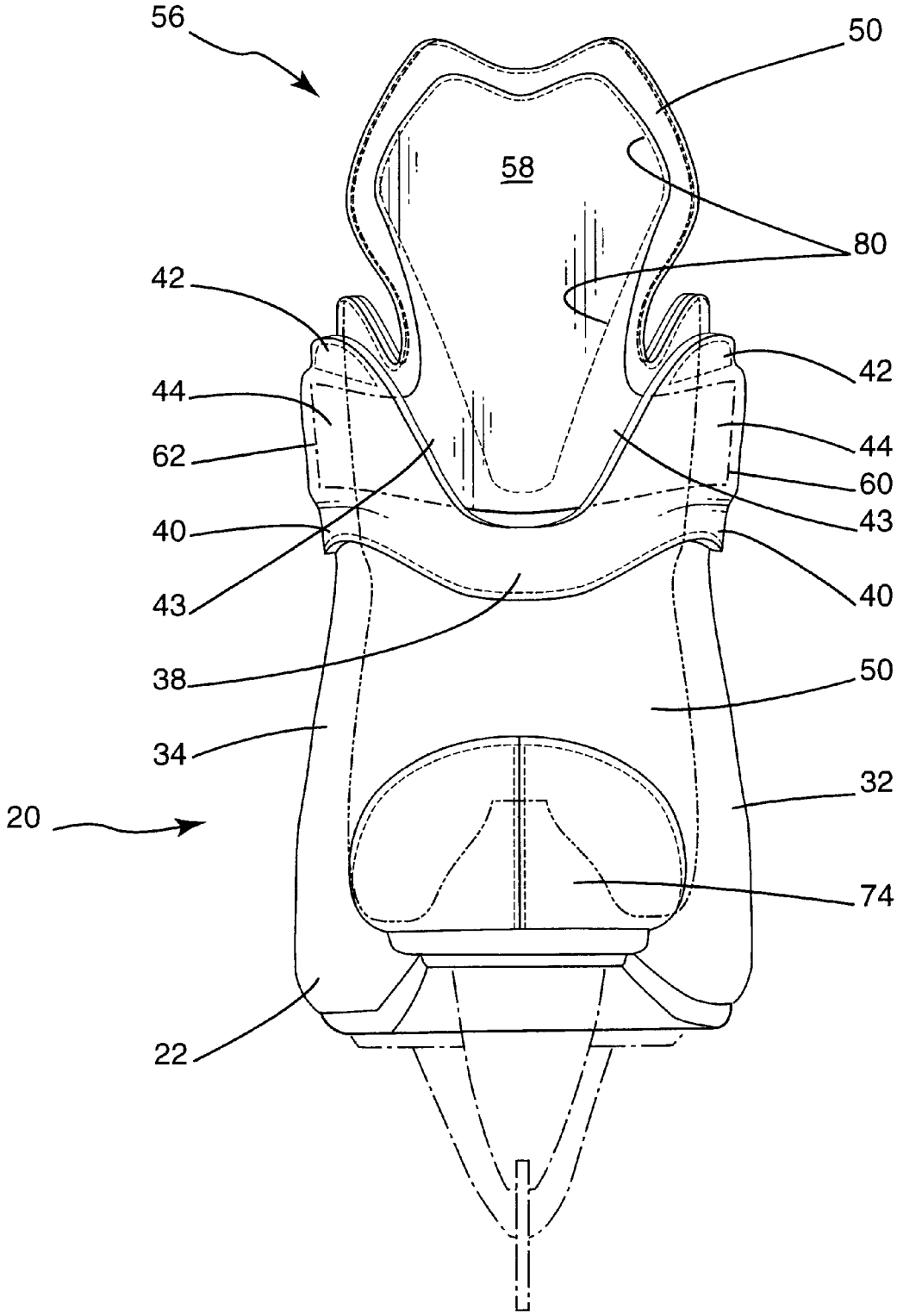

FIG. 6 is a rear view of skate boot 20 illustrating the construction of tendon guard 56 and the insertion of lateral extensions 60 and 62 in their respective rear openings 43. Tendon guard 56 is made of the upward extension 49 of ankle brace 50 to which is sewn reinforcement member 58. Sewing line 80 connects reinforcement member 58 to ankle brace 50. It must be noted that sewing line 80 only attaches the central portion of reinforcement member 58 to upward extension 49 of ankle brace 50 while each lateral extension 60 and 62 remains unattached. Lateral extensions 60 and 62 are therefore free to slide into passageways 44. As can be seen in FIG. 6, Passageways 44 are defined by the upper sewing lines 42 and the lower sewing line 40 attaching lateral shoulder 38 to foot element 22.

There are a variety of methods to assemble articulated cuff 24 with foot element 22. One method is to insert ankle brace 50 into foot element 22 and each lateral extension 60 and 62 outside foot element 22, and then sew lateral shoulder 38 to foot element 22 with stitching lines 40 and 42, thereby enclosing lateral extensions 60 and 62. Another method is to sew the bottom of lateral shoulder 38 with sewing line 40 leaving the upper side undone; the articulated cuff 24 is the inserted into foot element 22 and lateral extensions 60 and 62 into the unclosed lateral shoulder 38. Once assembled, the upper side of lateral shoulder 38 is sewn at lines 42 to close the upper side of each passageway 44 thereby enclosing lateral extensions 60 and 62 into passageways 44. Yet another method is to sew reinforcement member 58 to upward extension 49 after ankle brace 50 is installed inside foot element 22. Each lateral extension 60 and 62 is inserted into their respective passageway 44 and then reinforcement member 58 is sewn to upward extension 49 of ankle brace 50 at stitching line 80. Lateral extensions 60 and 62 are also sewn to ankle brace 50 at stitching lines 45 as is best shown in FIG. 5.

Figure 7A:
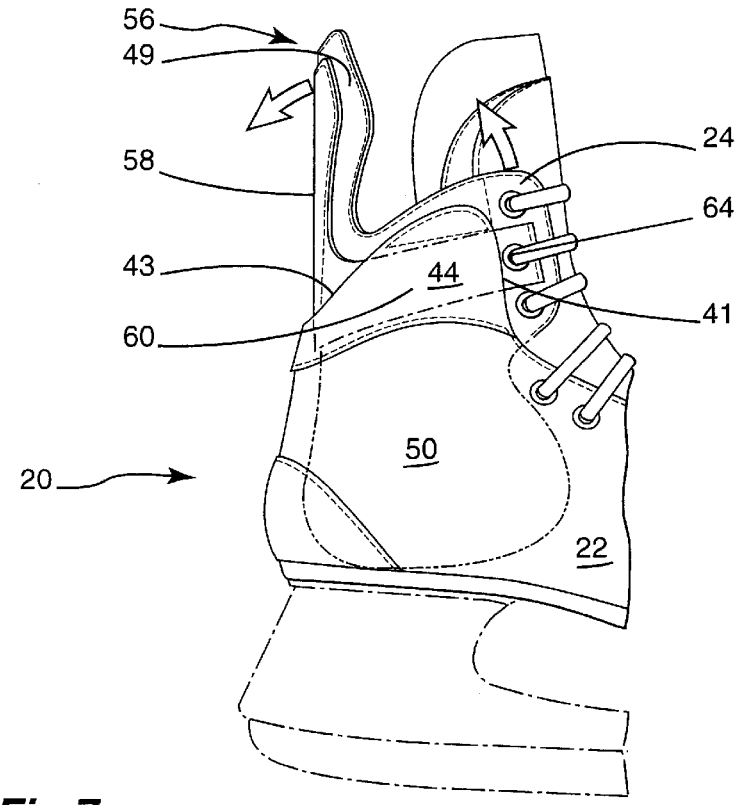
FIG. 7*a* partial side elevational view of the skate boot according to the invention showing in stippled lines the articulated cuff at its rearmost position.
Figure 7B:
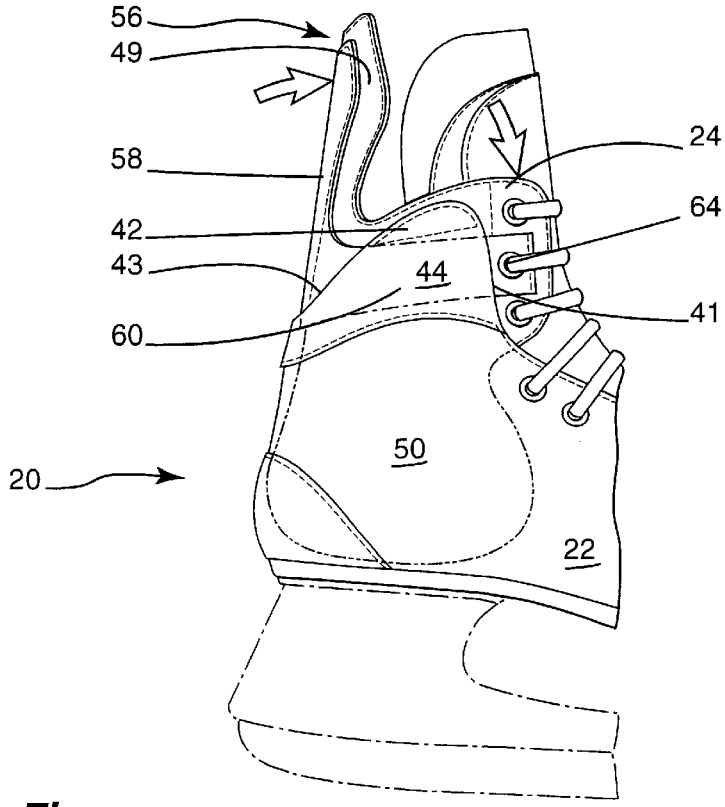

FIGS. 7*a* and 7*b* illustrate the forward and backward movements of articulated cuff 24. When the skater's ankle flexes backward, the bottom portion of ankle brace 50 move forward, partially following the heel of the skater while tendon guard 56 moves backward pushed by the rear portion of the leg. In FIG. 7*a*, lateral extension 60 has reached its rearmost position as eyelet 64 is stopped against the sides of front opening 41. In FIG. 7*b*, lateral extension 60 has reached its foremost position as the remain portion of reinforcement member 58 is butting against rear opening 43 and more specifically against upper stitching line 42. As can be seen from FIGS. 7*a* and 7*b*, lateral extensions 60 and 62 are also able to partially move up and down inside passageways 44. It should be noted that the pivotal motion of articulated cuff 24 is not centered on a fixed axis but on a swaying axis located somewhere in the vicinity the central portion of passageways 44 and coinciding approximately with the pivot axis of the skater's ankle. This dynamic of motion is caused by the somewhat loose connection of articulated cuff 24 with foot element 22. Since lateral extensions 60 and 62 may move forward and backward as well as up and down and rotationally, the pivotal axis of articulated cuff 24 is mobile within a limited zone.

The mobility of the pivotal axis increases the versatility of skate boot 20 to conform to various foot and ankle physiology. No two ankles being exactly alike, this type of loose connection allows for variations of the malleolis position. Skate boot 20 is adapted to first support the skater's ankle by tightening ankle brace 50 over the ankle, and secondly to allow pivotal movement of articulated cuff 24 relative to foot element 22 so that in every position, the skater's ankle is properly supported yet it is not restricted in its motion.

Figure 8:
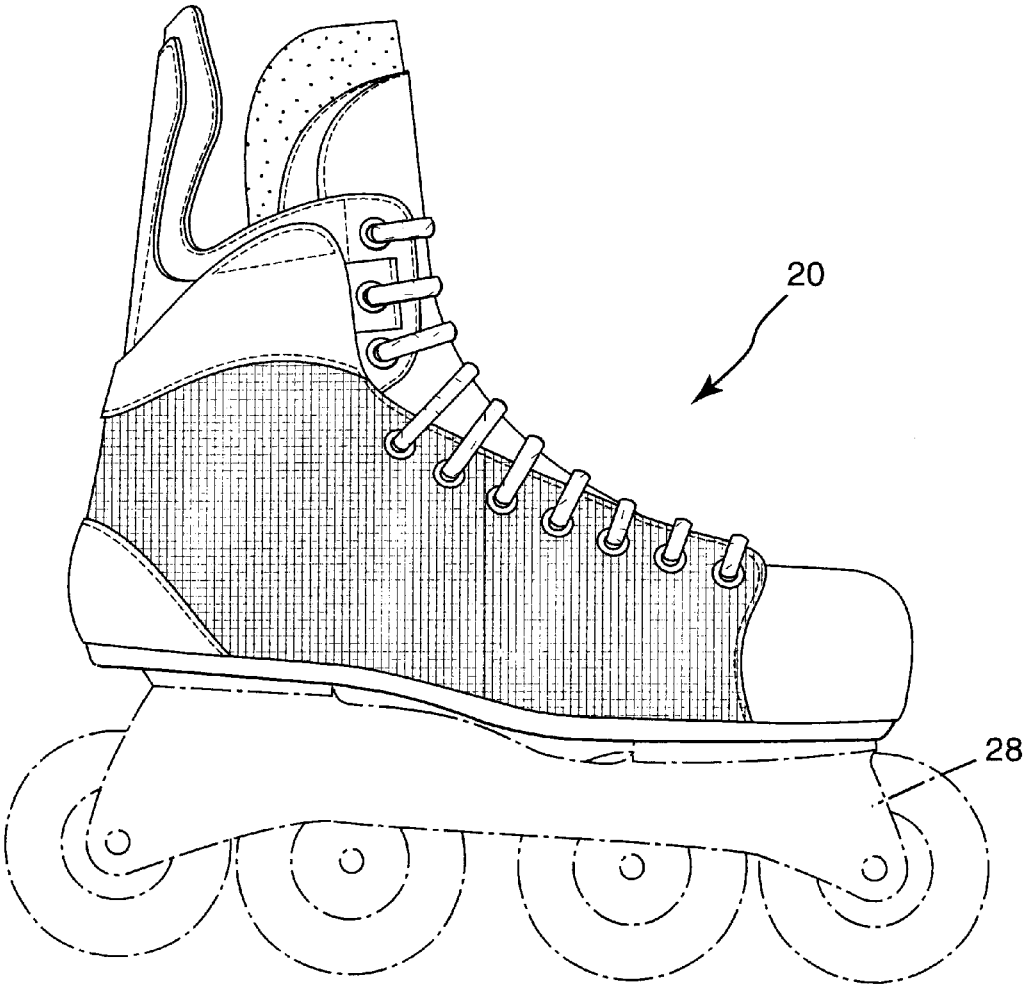
FIG. 8 is side elevational view of the skate boot according to the invention having an in-line roller chassis as an accessory.

FIG. 8 shows a skate boot 20 according to another embodiment of the invention having an in-line roller chassis 80 as an accessory.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. A skate boot comprising:

(a) a foot element adapted to be mounted to a ground engaging skating implement and for receiving at least partially the foot of a skater, said foot element comprising a passageway on each side of the skater's ankle; and (b) an articulated cuff for encircling and supporting the ankle of a skater; said articulated cuff being partially inserted in said foot element and comprising a belt like coupling having lateral extensions inserted in each said passageway thereby slidably coupling and linking said articulated cuff to said foot element to permit unrestrained limited pivotal motion of said articulated cuff relative to an axis coinciding approximately with the pivot axis of the skater's ankle.

2. A skate boot as defined in claim 1 wherein said passageway is made of a lateral shoulder attached to each quarter of said foot element with a lower stitching line and an upper stitching line which define said passageway therebetween.

3. A skate boot as defined in claim 2 wherein said articulated cuff includes an ankle brace supporting the back and sides of the skater's ankle and a tendon guard extending upwardly from said ankle brace for supporting and protecting the lower rear portion of the skater's leg, said tendon guard further comprising a reinforcement member.

4. A skate boot as defined in claim 3 wherein said reinforcement member comprises said belt like lateral extensions.

5. A skate boot as defined in claim 4 wherein said reinforcement member is attached to a rear portion of said articulated cuff and forward ends of said belt like lateral extensions is attached to said articulated cuff thereby coupling said articulated cuff to said passageways.

6. A skate boot as defined in claim 5 wherein said foot element includes a row of lace eyelets on each side for closing and tightening said foot element over the skater's foot; and said articulated cuff includes a row of lace eyelets on each side for closing and tightening said articulated cuff over the skater's ankle.

7. A skate boot as defined in claim 6 wherein said belt like lateral extensions further comprise a lace eyelet at the end of each lateral extension, said lace eyelet co-axial with one of said lace eyelets of said articulated cuff.

8. A skate boot as defined in claim 5 wherein said tendon guard is made of said reinforcement member combined with an upward extension of said ankle brace, said reinforcement member being of a material which is more rigid than said ankle brace thereby providing more support for the rear portion of the skater's leg.

9. A skate boot as defined in claim 8 wherein said ankle brace is padded for improving comfort.

10. A skate boot as defined in claim 2 wherein said belt like lateral extensions are capable of partial up and down motion inside said passageway.

11. A skate boot as defined in claim 2 wherein said belt like lateral extensions are capable of partial forward and backward motion inside said passageway.

12. A skate boot as defined in claim 1 wherein said articulated cuff is slidably coupled to said foot element to permit unrestrained limited rotation of said articulated cuff about a vertical axis coinciding approximately with the longitudinal axis of the skater's lower leg.

13. An ice skate for playing hockey and other similar sporting activities, said ice skate comprising a skate boot as defined in claim 1 and wherein said ground engaging skating implement is a runner assembly mounted to a bottom portion of said foot element.

14. An in-line roller skate comprising a skate boot as defined in claim 1 and wherein said ground engaging skating implement is a chassis having a plurality of in-line wheels, said chassis being mounted to a bottom portion of said foot element.

15. A skate boot comprising:

(a) a foot element for receiving a human foot having an ankle and a heel;

(b) a cuff comprising an ankle brace facing a rear portion and sides of the ankle and a lower portion extending downwardly from said ankle brace and facing the heel; and (c) a fastener for coupling said cuff to said foot element wherein said cuff is at least partially located in said foot element and said fastener permits a pivotal motion of said cuff relative to said foot element such that a backward movement of the foot imparts movement of said lower portion in a forward direction.

16. A skate boot as defined in claim 15 wherein said cuff further comprises an upward extension extending upwardly from said ankle brace and facing the rear portion of the ankle.

17. A skate boot as defined in claim 16 wherein said fastener permits a pivotal motion of said cuff relative to said foot element such that the backward movement of the foot imparts movement of said upward extension in a backward direction.

18. A skate boot as defined in claim 17 wherein said fastener permits a pivotal motion of said cuff relative to said foot element such that a forward movement of the foot imparts movement of said upward extension in a forward direction.

19. A skate boot as defined in claim 18 wherein said fastener permits a pivotal motion of said cuff relative to said foot element such that the forward movement of the foot imparts movement of said lower portion in a backward direction.

20. A skate boot as defined in claim 19 wherein said fastener comprises a belt like coupling.

21. A skate boot as defined in claim 20 wherein said foot element comprises first and second quarters, each of said first and second quarters comprising a passageway, said belt like coupling comprising respective belt like lateral extensions insertable in each of said passageways.

22. A skate boot as defined in claim 21 wherein each of said first and second quarters comprises a lateral shoulder with a lower stitching line and an upper stitching line defining said passageway therebetween.

23. A skate boot as defined in claim 22 wherein said upward extension comprises a reinforcement member.

24. A skate boot as defined in claim 23 wherein said said belt like lateral extensions are integrally formed with said reinforcement member.

25. A skate boot as defined in claim 24 wherein said reinforcement member covers at least partially said upward extension.

26. A skate boot as defined in claim 25 wherein each of said belt like lateral extensions is capable of partial up and down motions inside said passageways.

27. A skate boot as defined in claim 26 wherein each of said belt like lateral extensions is capable of partial forward and backward motions inside said passageways.

28. A skate boot as defined in claim 27 wherein said cuff comprises a row of lace eyelets on each side.

29. A skate boot as defined in claim 28 wherein said belt like lateral extensions further comprise a lace eyelet at one end thereof, said lace eyelet being co-axial with one of said lace eyelets of said cuff.

30. A skate boot as defined in claim 29 wherein said reinforcement member is more rigid than said cuff.

31. A skate boot as defined in claim 15 wherein said lower portion of said cuff comprises a recess for receiving a portion of the heel such that pivotal motion of said cuff relative to said foot element causes no substantial movement of the portion of the heel.

32. A skate boot as defined in claim 31 wherein said lower portion of said cuff comprises side flaps and a central band located therebetween, said central band facing the rear portion of the ankle, said side flaps facing sides of the ankle and the heel and extending below and away from said central band.

33. A skate boot as defined in claim 15 wherein said fastener comprises a lace engaging member.

34. A skate boot as defined in claim 33 wherein said lace engaging member comprises at least one eyelet provided on said cuff.

35. An ice skate comprising the skate boot as defined in claim 15 and wherein said skate boot comprises a ground engaging skating implement, said ground engaging skating implement being a runner assembly mounted to a bottom portion of said foot element.

36. An ice skate comprising the skate boot as defined in claim 15 and wherein said skate boot comprises a ground engaging skating implement, said ground engaging skating implement being a chassis having a plurality of in-line wheels, said chassis being mounted to a bottom portion of said foot element.

37. A skate boot comprising:

(a) a foot element for receiving a human foot having an ankle and a heel;

(b) a cuff comprising an ankle brace facing a rear portion and sides of the ankle and a lower portion extending downwardly from said ankle brace and facing the heel; and (c) a fastening means for coupling said cuff to said foot element wherein said cuff is at least partially located in said foot element and said fastening means permits a pivotal motion of said cuff relative to said foot element such that a backward movement of the foot imparts movement of said lower portion in a forward direction.

38. A skate boot as defined in claim 37 wherein said cuff further comprises an upward extension extending upwardly from said ankle brace and facing the rear portion of the ankle.

39. A skate boot as defined in claim 38 wherein said fastening means permits a pivotal motion of said cuff relative to said foot element such that the backward movement of the foot imparts movement of said upward extension in a backward direction.

40. A skate boot as defined in claim 39 wherein said fastening means permits a pivotal motion of said cuff relative to said foot element such that a forward movement of the foot imparts movement of said upward extension in a forward direction.

41. A skate boot as defined in claim 40 wherein said fastening means permits a pivotal motion of said cuff relative to said foot element such that the forward movement of the foot imparts movement of said lower portion in a backward direction.

42. A skate boot as defined in claim 41 wherein said fastening means comprises a belt like coupling.

43. A skate boot as defined in claim 42 wherein said foot element comprises first and second quarters, each of said first and second quarters comprising a passageway, said belt like coupling comprising respective belt like lateral extensions insertable in each of said passageways.

44. A skate boot as defined in claim 43 wherein each of said first and second quarters comprises a lateral shoulder with a lower stitching line and an upper stitching line defining said passageway therebetween.

45. A skate boot as defined in claim 44 wherein said upward extension comprises a reinforcement member.

46. A skate boot as defined in claim 45 wherein said said belt like lateral extensions are integrally formed with said reinforcement member.

47. A skate boot as defined in claim 46 wherein said reinforcement member covers at least partially said upward extension.

48. A skate boot as defined in claim 47 wherein each of said belt like lateral extensions is capable of partial up and down motion inside said passageways.

49. A skate boot as defined in claim 48 wherein each of said belt like lateral extensions is capable of partial forward and backward motion inside said passageways.

50. A skate boot as defined in claim 49 wherein said cuff comprises a row of lace eyelets on each side.

51. A skate boot as defined in claim 50 wherein said belt like lateral extensions further comprise a lace eyelet at one end thereof, said lace eyelet being co-axial with one of said lace eyelets of said cuff.

52. A skate boot as defined in claim 51 wherein said reinforcement member is more rigid than said cuff.

53. A skate boot as defined in claim 37 wherein said lower portion of said cuff comprises a recess for receiving a portion of the heel such that pivotal motion of said cuff relative to said foot element causes no substantial movement of the portion of the heel.

54. A skate boot as defined in claim 53 wherein said lower portion of said cuff comprises side flaps and a central band located therebetween, said central band facing the rear portion of the ankle, said side flaps facing sides of the ankle and the heel and extending below and away from said central band.

55. A skate boot as defined in claim 37 wherein said fastening means comprises a lace engaging member.

56. A skate boot as defined in claim 35 wherein said lace engaging member comprises at least one eyelet provided on said cuff.

* * * * *

UNITED STATES PATENT AND TRADEMARK OFFICE

CERTIFICATE OF CORRECTION

PATENT NO. : 6,550,159 B1
DATED : April 22, 2003
INVENTOR(S) : Carl Madore

It is certified that error appears in the above-identified patent and that said Letters Patent is hereby corrected as shown below:

Columns 7 and 9,
Claims 24 and 46, delete the word "said" in "where said said belt like" 1st occurrence
Claim 56, replace "35" by -- 55 --

Signed and Sealed this

Sixteenth Day of September, 2003

JAMES E. ROGAN
*Director of the United States Patent and Trademark Office*